US006557620B2

(12) United States Patent
Oshimo

(10) Patent No.: US 6,557,620 B2
(45) Date of Patent: May 6, 2003

(54) ATTACHMENT APPARATUS FOR HEATER

(75) Inventor: Junichi Oshimo, Hiroshima (JP)

(73) Assignee: The Japan Steel Works, Ltd., Tokyo (JP)

( * ) Notice: Subject to any disclaimer, the term of this patent is extended or adjusted under 35 U.S.C. 154(b) by 0 days.

(21) Appl. No.: 09/777,821

(22) Filed: Feb. 7, 2001

(65) Prior Publication Data

US 2002/0105120 A1 Aug. 8, 2002

(51) Int. Cl.[7] ..... B22D 17/04

(52) U.S. Cl. ..... 164/312; 164/341; 164/338.1; 373/156; 219/521

(58) Field of Search ..... 164/312, 341, 164/137, 338.1, 338.2, 118; 373/156; 219/521, 531, 536

(56) References Cited

U.S. PATENT DOCUMENTS 5,991,328 A * 11/1999 Choudhury et al. ..... 373/156

6,025,576 A * 2/2000 Beck et al. ..... 219/521

FOREIGN PATENT DOCUMENTS

JP 11-115015 4/1999 ..... B29C/45/74

* cited by examiner

*Primary Examiner*—Tom Dunn
*Assistant Examiner*—I.-H. Lin
(74) *Attorney, Agent, or Firm*—Sughrue Mion, PLLC

(57) ABSTRACT

An attachment apparatus for a heater for attaching the heater, which is configured in an almost circular shape in its side view and cut at a circumferential portion thereof to form opposite circumferential end portions, to an external peripheral portion of a heated member of a cylindrical or column shape, includes a pair of stop metal members fixed near the circumferential end portions of the heater and a spring, both end portions of the spring engaged with the stop metal members in a state being pulled by the stop metal members with a predetermined tension, respectively, the opposite circumferential end portions of the heater are attracted to each other and so the heater is elastically adhered to the external peripheral portion of the heated member.

8 Claims, 2 Drawing Sheets

ATTACHMENT APPARATUS FOR HEATER

BACKGROUND OF INVENTION

1. Field of Invention

The present invention relates to an attachment apparatus for a heater for attaching the heater, which is configured in an almost circular shape in its side view and cut at a circumferential portion thereof to form opposite circumferential end portions, to the external peripheral portion of a heated member of a cylindrical or column shape. In particular, the invention relates to an attachment apparatus for a heater suitable to be provided at the external peripheral portion of a heat cylinder of an injection molding machine for metal.

2. Related Art

Metal molded items made of magnesium alloy, aluminum alloy etc., for example, are also formed by the injection molding. The injection molding machine for metal used for such injection molding is configured, as is well known, by a heat cylinder, a screw provided within an inner hole of the heat cylinder so as to be able to be driven in the axial direction and the rotational direction, and a screw driving device for driving the screw etc. An injection nozzle is provided at the front portion of the heat cylinder. Each of the heat cylinder and the injection nozzle is provided at its outer peripheral portion with a plurality of electric heaters, that is, heaters which are adapted to control the temperature independently. Thus, at the time of measuring an amount, as is well known, the metal material supplied to the heat cylinder is melted by the heat mainly supplied from the heater, then accumulated at the front portion of the heat cylinder and subject to the amount measurement.

As shown in (a) of FIG. 2, such a heater 30 is configured in an almost circular shape in its side view by a heat portion 33 formed by the combination of an insulator 31 made of ceramic, mica etc. and a nichrome wire 32, and a heater outer cover 34 for protecting the heat portion 33. The heater is cut at a portion to have abutment portions 35, 35'. As also shown in (b) of FIG. 2, the attachment apparatus for the heater 30 is formed by a pair of attachment metal members 36, 36', a pair of rod-shaped members 37, 37' and a bolt 38 etc. The pair of attachment metal members 36, 36' are bent in ring shapes and fixed in the vicinity of the abutment portions 35, 35' of the heater 30 by the welding, respectively. The rod-shaped member 37' is provided with a through hole through which the shaft portion of the bolt 38 is passed and the other rod-shaped member 37 is provided with female screw or internal threads to be engaged with the bolt 38. The heater 30 is attached to the external peripheral portion of a heated member of a cylindrical or column shape, for example, a heat cylinder 40 in the following manner by using the aforesaid attachment metal members 36, 36'. That is, the heater 30 is attached to the external peripheral portion of the heat cylinder 40, and then the pair of the rod-shaped members 37, 37' are inserted into the ring-shaped bent portions of the attachment metal members 36, 36', respectively. Then, the shaft portion of the bolt 38 is inserted into the through hole of the other rod-shaped member 37' and the bolt 38 is screwed into the threads of the one rod-shaped member 37. Thus, the abutment portions 35, 35' are attracted to each other and so the heater 30 is adhesively attached to the external peripheral portion of the heat cylinder 40.

Although not shown in the drawings, the heater is also attached to the heat cylinder by using a marketed commodity called as a catch clip or a snap fastener in place of the aforesaid attachment apparatus.

Although the heater 30 can be attached to the heat cylinder 40 by using each of the aforesaid attachment apparatus and the marketed commodity called as the catch clip or the snap fastener, there arises many problems. For example, there may arise a case that the heater 30 can not be removed in order to replace it for a new one. That is, in the case of heating the heat cylinder 40 of the injection molding machine for metal to 550° C. by using the heater 30 which normal usage temperature is set at 550° C., the temperature of the heater 30 itself may not be limited to 550° C. and the temperature of the heater outer cover 34 may increase to a temperature higher about 200 to 400° C. than 550° C. which is the heating temperature of the heat cylinder 40. In particular, when the heater outer cover 34 is heated in a state that heat reserving material is wound around the outside of the heater outer cover in order to prevent the heat radiation, the temperature of the heater outer cover 34 further increases. Thus, it is experienced in the heat cylinder of the injection molding machine for metal that since the bolt is heated to such a high temperature, the bolt 38 is burnt, whereby the heater 30 can not be removed for replacing it for a new one unless the attachment apparatus of the heater 30 is broken. Although it is considered that such a burning phenomenon can be prevented when burning prevention material such as high-temperature heat-resistant grease etc. is coated on the bolt 38, it is experienced that the burning prevention material does not attain any effect in the heat cylinder of the injection molding machine for metal. Further, the grease itself may be burnt and hardened depending on an amount of the grease coated to thereby obstruct the removal of the bolt 38.

Furthermore, since the degree of adhesion of the heat portion 33 of the heater 30 to the heat cylinder 40 reduces, there arises various problems. That is, the heater outer cover 34 is generally formed by stainless steel and the heater outer cover 34 is pulled by the bolt 38 of the attachment apparatus, so that the heat portion 33 is adhered to the heat cylinder 40. Such a pulling force can be adjusted depending on the fastening force of the bolt 38. As for the heat cylinder 40 of the injection molding machine for metal, the bolt is fastened so that a high tension of about 70 to 100N is applied to the heater outer cover. When the heater 33 is made conductive in a state where such a high tension acts on the heater outer cover, the heater outer cover 34 increases in its temperature and expands earlier than the heat cylinder since the heat capacity of the heater outer cover 34 is smaller than that of the heat cylinder 40. Although the heat cylinder 40 also increases in its temperature with the lapse of the time, since the heat cylinder 40 is larger in its volume than the heater outer cover 34, the heat cylinder is larger in its amount of the expansion than the heater outer cover and hence the heater outer cover 34 further expands. In other words, the heater outer cover 34 expands due to the creep phenomenon caused by the time difference of the thermal expansion between the heat cylinder and the heater outer cover, so that the setting fastening force can not be maintained. As a result, the heat portion reduces in its degree of the adhesion to the heat cylinder and there appears gaps partially between the heat cylinder and the heater outer cover. When the degree of the adhesion reduces in this manner, the heat transmission coefficient between the heat cylinder and the heat portion reduces. Further, when there appears gaps partially between the heat cylinder and the heat portion, the heat transmission efficiency therebetween varies or becomes uneven partially, which results in the cause of the "bending phenomenon" of the heat cylinder 40 and adversely affects the heat cylinder 40 due to the thermal stress. Furthermore, an amount of heat transmitted from the heat portion 33 to the heat cylinder 40 reduces due to the gaps, whereby the temperature of the heat portion 33 increases partially to an excessive value. Thus, the life time of the nichrome wire 32 becomes shorter since the oxidization of the nichrome wire 32 proceeds. Further, the nichrome wire 32 melts due to the excessive temperature, which results in the breaking of the wire.

The aforesaid phenomenon also results in the reduction of the producibility. To be more concrete, although the heater 30 should be exchanged in a short time as possible in view of the producibility, the temperature of the heat cylinder 40 reaches about 600° C. during the operation and so it is hard to operate the bolt 38. Further, as described above, since the bolt 38 is burnt, it is quite difficult to exchange the heater. As a result, the exchange procedure of the heater can not be performed until the temperature of the heat cylinder 40 decreases, which results in a cause of reduction of the working ratio.

In this respect, the catch clip or the snap fastener can be operated relatively easily and so the attachment and the removal of the heater 3 can be easily performed relatively, but these commodities are complicated in the construction and the component parts thereof are expensive. Further, since all the constituent parts of these commodities are integrated by the welding etc., there is a draw back that the these commodities can not be used repeatedly since it is impossible to exchange only broken or damaged parts. As a countermeasure, it is considered that the apparatus is fabricated by heat-resistant material such as Inconel 718 to improve the efficiency of the apparatus such as durability etc. However, in this case, the cost of the apparatus further increases. Thus, when the heater 30 is broken, it is uneconomical since the expensive constituent parts as well as the heater 30 must be disposed simultaneously.

SUMMARY OF INVENTION

Accordingly, an object of the invention is to provide an attachment apparatus for a heater which is formed by the aforesaid conventional bolt etc. or which eliminates the aforesaid problems and drawbacks etc. of the catch clip or the snap fastener. To be concrete, an object of the invention is to provide an attachment apparatus for a heater which can easily attach and remove the heater, maintain high degree of the adhesion between the heater and a heated member, and be low in cost.

In order to attain the aforesaid object, the invention is arranged in a manner that in an attachment apparatus for a heater for attaching the heater, which is configured in an almost circular shape in its side view and cut at a circumferential portion thereof to form opposite circumferential end portions, to an external peripheral portion of a heated member of a cylindrical or column shape, the attachment apparatus includes a pair of stop metal members fixed near the circumferential end portions of the heater and a spring, wherein both end portions of the spring are engaged with the stop metal members in a state being pulled by the stop metal members with a predetermined tension, respectively, whereby the opposite circumferential end portions of the heater are attracted to each other and so the heater is elastically adhered to the external peripheral portion of the heated member.

In the present invention, the spring is separated from the heater by a predetermined length outward to a radial direction.

In the present invention, a plurality of the springs are provided in parallel.

In the present invention, the heated member is a heat cylinder of an injection molding machine for metal.

DETAILED DESCRIPTION OF DRAWINGS

FIG. 1(*c*) is a sectional view shown from a line B—B in FIG. 1(*b*).

FIG. 2(*b*) is an enlarged plan view of the attachment apparatus.

DETAILED DESCRIPTION OF PREFERRED EMBODIMENTS

Figure 1A:
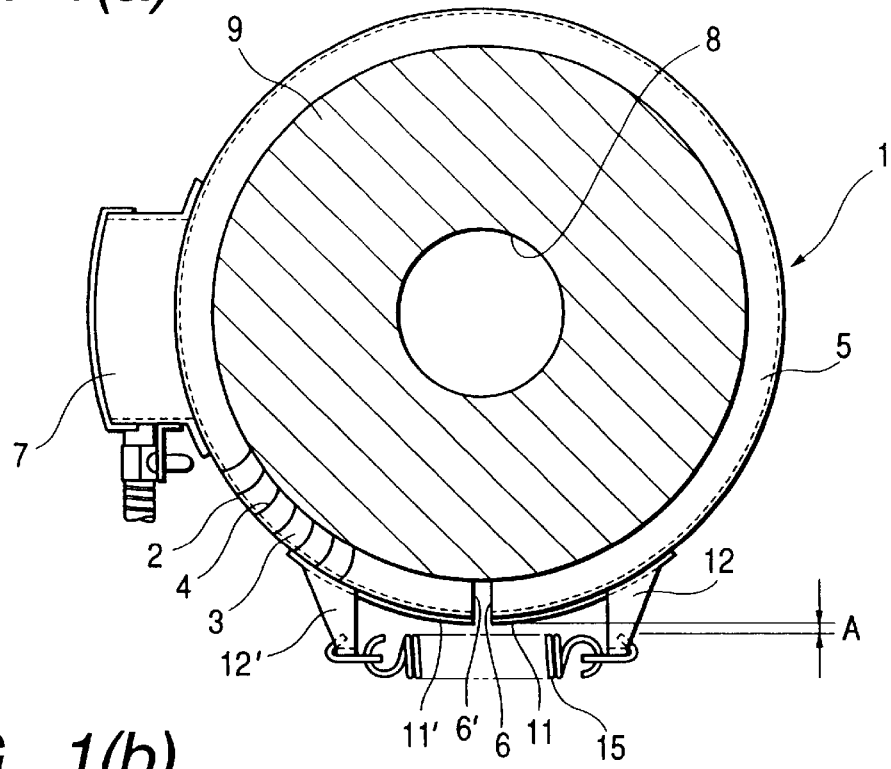
FIG. 1(*a*) is the side view of an attachment apparatus of the invention in which a heat cylinder is shown in section, FIG. 1(*b*) is an enlarged plain view of the attachment apparatus.

The embodiment of the invention will be explained with reference to FIG. 1. Like the conventional heat portion, as shown in (a) of FIG. 1, the heat portion 2 of a heater 1 according to the embodiment is configured by an insulator 3 formed by ceramic, mica etc. and a nichrome wire 4 wound around the insulator 3 in a coil fashion. The external peripheral portion of the heat portion 2 is covered by a heater outer cover 5 formed by stainless steel, for example. As shown in (a) of FIG. 1 as the side view, such a heater 1 is cut at a circumferential portion thereof to form opposite circumferential end portions 6, 6', but the heater is configured in a ring shape as a whole and has elasticity slightly. Thus, although described in detail later, the heater can be attached to the heated member by fastening the heater such that the circumferential end portions 6, 6' approach to each other. A reference numeral 7 in (a) of FIG. 1 depicts the terminal for coupling a power source.

According to the embodiment, the heated member is a heat cylinder 9 of an injection molding machine for metal having an inner hole 8 in which a screw is provided so as to be able to be driven in the axial direction and the rotational direction. According to the embodiment shown in FIG. 1, the attachment apparatus for attaching the heater 1 to the external peripheral portion of the heat cylinder 9 is configured by a pair of first and second stop metal members 10, 10', a coil spring 15 provided between these stop metal members 10, 10', and a pair of first and second hook metal members 20, 20' attached to the both end portions of the coil spring 1, respectively. Since the pair of the stop metal members 10, 10' and the pair of the hook metal members 20, 20' are configured symmetrically, the explanation will be made only as to one of the stop metal members and one of the hook metal members, and the other of the stop metal members and the other of the hook metal members are added with ['] to the same reference numerals and the explanation thereof will be omitted.

Figure 1B:
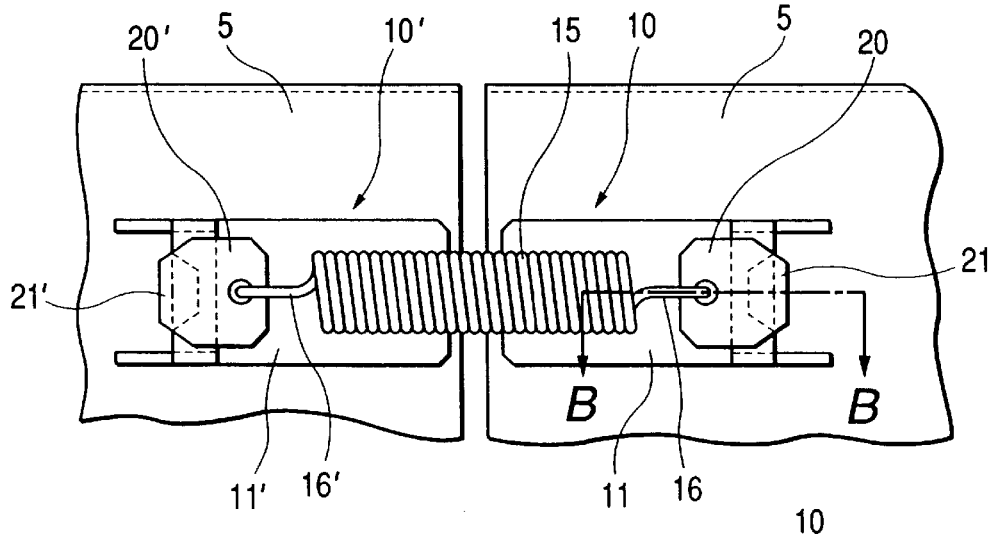
Figure 1C:
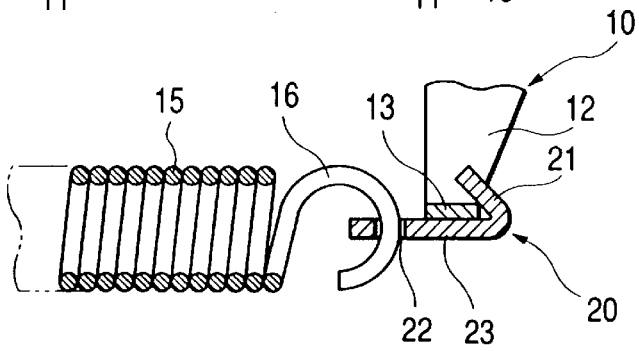
Figure 2A:
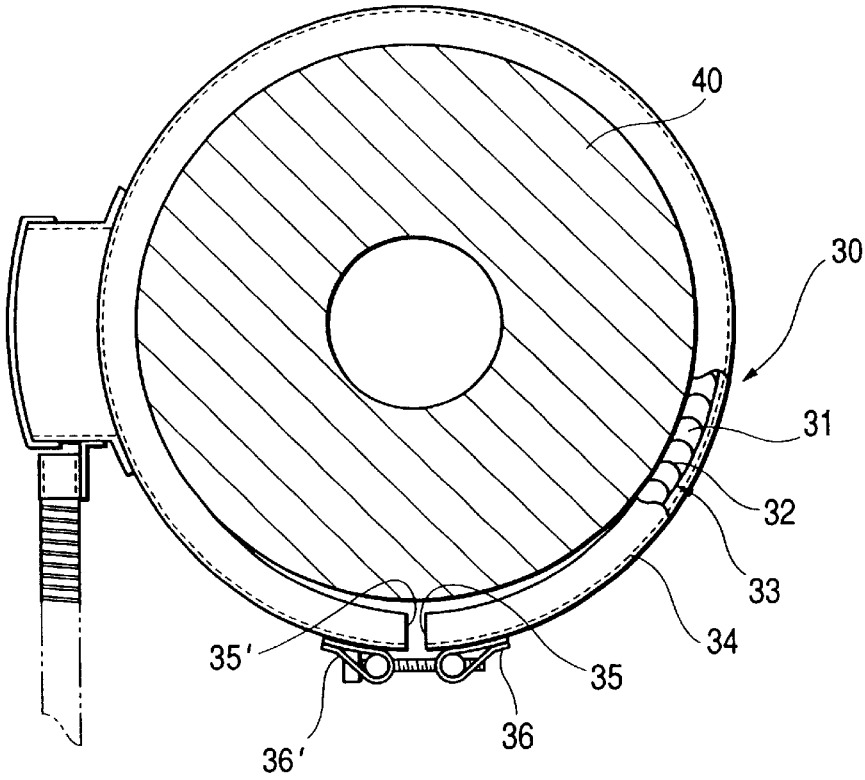
FIG. 2(*a*) is the side view of a conventional attachment apparatus in which a heat cylinder is shown in section.
Figure 2B:
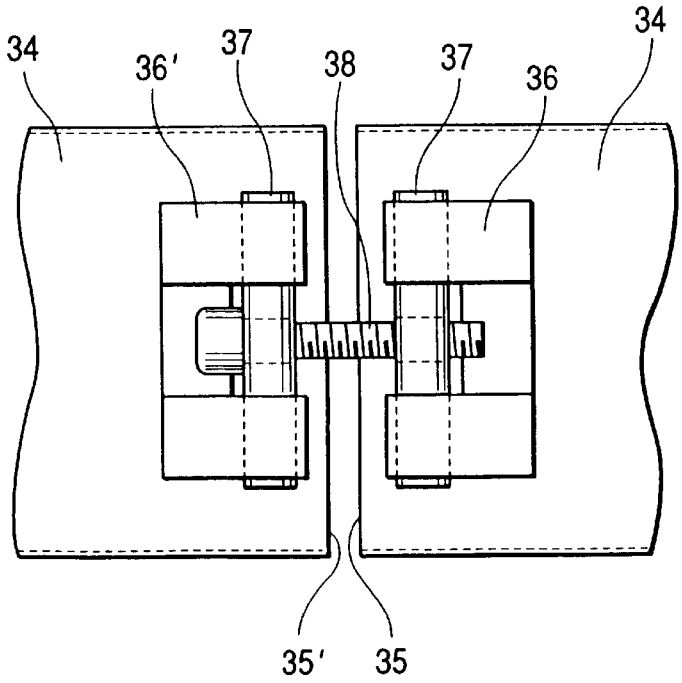

The first stop metal member 10 is integrally formed by a fixed portion 11 which is configured in an almost arc shape and to have a predetermined length and a predetermined area, a rising portion 12 which is raised near the right end portion thereof to have a predetermined height in (a) of FIG. 1, and a hook portion 13 which is formed at the tip end portion of the rising portion 12. The first stop metal member 10 is fixedly attached to the heater outer cover 5 by the welding, rivets etc. in a manner that the left end portion of the fixed portion 11 is positioned near the circumferential end portion 6 of the heater 1. Since the fixed portion 11 and the rising portion 12 are disposed in the aforesaid positional relation, when the hook portions 13, 13' are attracted to each other by the coil spring 15 as described later, the heat portion 2 of the heater 1 is adhered also at its portions near the circumferential end portions 6, 6' to the external peripheral surface of the heat cylinder 9.

The first hook metal member 20 is integrally formed by a hook portion 21 bent with an acute angle and a main body portion 23 provided with a through hole 22. The hook portion 21 of the first hook metal member 20 is engaged with the hook portion 13 of the first stop metal member 10. The hook 16 of the coil spring 15 is passed through the through hole 22. The hooks 16, 16' are integrally provided at the both end portions of the coil spring 15, respectively. The coil spring 15 is set in a manner that the diameter thereof is smaller than the height of the rising portion 12 of the first stop metal member 10. Thus, as described later, when the heater 1 is attached to the heat cylinder by the attachment apparatus, a distance A, for example, a clearance of 5 mm or more is secured between the heater outer cover 5 and the coil spring 15 as shown (a) of FIG. 1.

Then, the action of the embodiment will be explained. In advance, the first and second hook metal members 20, 20' are attached to the hooks 16, 16' of the coil spring 15, respectively. Then, the heater 1 is attached to the external peripheral portion of the heat cylinder 9. In this state, the hook portions 21, 21' of the hook metal members 20, 20' are engaged with the hook portions 13, 13' of the first and second stop metal members 10, 10', respectively. Thus, the first and second stop metal members 10, 10', that is, the both circumferential end portions 6, 6' of the heater 1 are attracted to each other with a predetermined tension by the resilience of the coil spring 15. As a result, the heat portion 2 of the heater 1 is adhesively attached to the external peripheral portion of the heat cylinder 9. In this state, when the current is supplied to the nichrome wire 4 of the heat portion 2, the heat portion 2 increases in its temperature earlier than the heat cylinder, so that the heater outer cover 5 expands and extends. However, in this embodiment, the coil spring 15 absorbs such an extension of the heater outer cover. Thus, degree of the adhesion between the heat portion 2 of the heater 1 and the heat cylinder 9 is maintained, whereby the heat cylinder 9 is effectively heated. When the temperature of the heat cylinder 9 increases after the lapse of time, in place of the heat portion, the heat cylinder 9 with a larger volume expands largely. However, the extension of the heater outer cover 5 due to the expansion of the heat cylinder 9 is also absorbed by the coil spring 15. In this manner, since the pulling force caused by the time difference of the expansion and shrinkage between the heat cylinder 9 and the heat portion 2 is absorbed by the expansion and contraction force of the coil spring 15, the reduction of the adhesion degree and the generation of partial gaps caused by the extension of the heater outer cover 5 can be prevented.

When exchanging the hater 1 for a new one, the exchanging procedure is performed in the order opposite to the aforesaid procedure in a manner that the coil spring 15 is removed and the hater 1 is exchanged for a new one. According to the embodiment, only the first and second stop metal members 10, 10' are fixed to the heater outer cover 5, and both the coil spring 15 and the hook metal members 20, 20' are separated from the heater outer cover 5 by the distance A, so that both the coil spring and the hook metal members are not subjected to the thermal deterioration due to the thermal transmission. Thus, both the coil spring 15 and the first and second hook metal members 20, 20' can be reused.

The invention is not limited to the aforesaid embodiment and it will be clear that the invention can be used in various modes. For example, the number of the coil springs 15 disposed in parallel may be changed to adjust the fastening force thereof. Further, it will be clear that the fastening force can be adjusted depending on the position of the through hole 22 formed at the main body portion 23 of the hook metal member 20. Furthermore, heat insulating material may be attached between the heater outer cover 5 and the coil spring 15 to thereby also block radiation heat. Further, according to the embodiment, both the coil spring 15 and the first and second hook metal members 20, 20' may be formed by heat-resistant alloy material such as Inconel 718 etc. which is high in high-temperature strength to thereby extend the durable terms thereof. Even when both the coil spring and the hook metal members are formed by relatively high-cost material such as Inconel 718, it is not uneconomical since they are reused. Furthermore, according to the embodiment, since the pair of the stop metal members 10, 10' and the pair of the hook metal members 20, 20' etc. are configured symmetrically, the fabricating cost thereof is cheap and they can be handled easily. However, it will be clear that the invention is applicable to a case where the pair of the stop metal members and the pair of the hook metal members etc. are not configured symmetrically.

As described above, according to the invention, the invention is arranged in a manner that in the attachment apparatus for a heater for attaching the heater, which is configured in an almost circular shape in its side view and cut at the circumferential portion thereof to form the opposite circumferential end portions, to the external peripheral portion of the heated member of a cylindrical or column shape, the attachment apparatus includes the pair of stop metal members fixed near the circumferential end portions of the heater and the spring, wherein both the end portions of the spring are engaged with the stop metal members in a state being pulled by the stop metal members with a predetermined tension, respectively, whereby the opposite circumferential end portions of the heater are attracted to each other and so the heater is elastically adhered to the external peripheral portion of the heated member. Thus, since the heater can be attached to the heated member by merely engaging the both end portions of the spring with the pair of the stop metal members, respectively, the heater can be removed easily even if the heated member is in a high-temperature state. Further, since both the end portions of the spring are engaged with the stop metal members in a state being pulled by the stop metal members with the predetermined tension, respectively, the adherence state between the heater and the heated member can be maintained even if there is a difference of the thermal expansion between the heater and the heated member. Thus, the thermal transmission between the heater and the heated member can be kept in a good state, and so there does not arise such a problem that the heated member is adversely affected thermally due to the partial unevenness of the thermal transmission property between the heater and the heated portion caused by gaps therebetween. Further, according to the invention, since the attachment apparatus for the heater is configured by the pair of stop metal members and the spring, the configuration of the apparatus is simple and the cost thereof is cheap advantageously. According to another invention, since the spring is separated from the heater by the predetermined length outward to the radial direction, the invention is advantageous in that the spring is prevented from being thermally deteriorated and the apparatus is economical since the spring can be reused. Further, according to still another invention, since a plurality of the springs are provided in parallel, in addition to the aforesaid advantage, the fastening force with respect to the heater can be adjusted by changing the number of the springs. Furthermore, according to still another invention, since the heated member is a heat cylinder of an injection molding machine for metal, the aforesaid advantages can be obtained even if the heat cylinder is heated to a relatively high temperature.

What is claimed is:

1. An attachment apparatus for a heater for attaching said heater, which is configured in an almost annular shape, to an external peripheral portion of a heated member of a cylindrical or column shape, comprising:

an outer cover configured in the same annular shape as said heater in its side view and cut at a circumferential portion thereof to form opposite circumferential end portions, said outer cover is capable of being disposed adjacent the heater;

a pair of stop metal members fixed near said circumferential end portions of said outer cover and a spring, both end portions of said spring engaged with said stop metal members in a state being pulled by said stop metal members with a predetermined tension, respectively, said opposite circumferential end portions of said outer cover are attracted to each other and so said heater is elastically adhered to the external peripheral portion of said heated member, wherein said spring is separated from said outer cover by a predetermined length outward in a radial direction.

2. An attachment apparatus for a heater according to claim 1, wherein said heated member is a heat cylinder of an injection molding machine for metal.

3. An attachment apparatus for a heater according to claim 1, wherein a plurality of said springs are provided in parallel.

4. An attachment apparatus for a heater according to claim 3, wherein said heated member is a heat cylinder of an injection molding machine for metal.

5. An attachment apparatus for a heater according to claim 1, wherein said spring is separated from said heater by a predetermined length outward to a radial direction.

6. An attachment apparatus for a heater according to claim 5, wherein said heated member is a heat cylinder of an injection molding machine for metal.

7. An attachment apparatus for a heater according to claim 5, wherein a plurality of said springs are provided in parallel.

8. An attachment apparatus for a heater according to claim 7, wherein said heated member is a heat cylinder of an injection molding machine for metal.

* * * * *